US009282780B2

(12) United States Patent
Toronjo et al.

(10) Patent No.: US 9,282,780 B2
(45) Date of Patent: Mar. 15, 2016

(54) ARTICLE OF FOOTWEAR FOR USE WITH A PROSTHETIC

(71) Applicant: UNDER ARMOR, INC., Baltimore, MD (US)

(72) Inventors: Alan Toronjo, Baltimore, MD (US); Vincent Chen, Guangzhou (CN); Kevin Fallon, Baltimore, MD (US); Troy Hopkins, Schertz, TX (US)

( * ) Notice: Subject to any disclaimer, the term of this patent is extended or adjusted under 35 U.S.C. 154(b) by 384 days.

(21) Appl. No.: 13/833,320

(22) Filed: Mar. 15, 2013

(65) Prior Publication Data

US 2014/0259765 A1 Sep. 18, 2014

(51) Int. Cl.

| | |
|---|---|
| ***A43B 3/00*** | (2006.01) |
| ***A43C 1/00*** | (2006.01) |
| ***A43B 5/00*** | (2006.01) |
| ***A43B 7/14*** | (2006.01) |
| ***A43C 11/14*** | (2006.01) |

(52) U.S. Cl.

CPC ..... *A43B 3/0036* (2013.01); *A43B 5/00* (2013.01); *A43B 7/147* (2013.01); *A43C 1/006* (2013.01); *A43C 11/1493* (2013.01)

(58) Field of Classification Search

CPC ..... A43B 3/24; A43B 3/248; A43B 3/0036; A43B 7/00; A43B 7/147; A43C 1/006; A61F 2002/6614; A61F 2002/665; A61F 2002/5001

USPC ..... 36/100, 111, 7.2, 7.4, 7.7, 1; 623/29

See application file for complete search history.

(56) References Cited

U.S. PATENT DOCUMENTS

| | | | | |
|---|---|---|---|---|
| 1,539,762 | A * | 5/1925 | Mussabini | 36/97 |
| 2,246,562 | A * | 6/1941 | Whitley | 36/7.2 |
| 3,142,911 | A * | 8/1964 | Raborg | 36/97 |
| 3,406,469 | A * | 10/1968 | Dani | 36/133 |
| 6,298,583 | B1 * | 10/2001 | Allen | 36/100 |
| 2010/0140310 | A1 * | 6/2010 | Goldberg et al. | 224/577 |
| 2011/0061266 | A1 * | 3/2011 | Hsieh et al. | 36/107 |
| 2013/0024008 | A1 * | 1/2013 | Treger et al. | 623/55 |

OTHER PUBLICATIONS

Nike Sole Tech Sheet, NikeInc.com, downloaded Mar. 14, 2013.

Max Eddy, Nike Invents Shoe for Prosthetic Legs, Can Now Sell Shoes to People Without Feet, www.geekosystem.com, Feb. 7, 2012.

* cited by examiner

*Primary Examiner* — Ted Kavanaugh

(74) *Attorney, Agent, or Firm* — Harness, Dickey & Pierce, P.L.C.

(57) ABSTRACT

An article of footwear for a prosthesis is provided and may include an upper, an outsole attached to the upper, and a midsole disposed between the upper and the outsole. The article of footwear may also include a cavity having a first portion defined between the upper and the midsole that receives the prosthesis when the prosthesis is inserted into the article of footwear and a second portion having a constant dimension between the upper and the midsole along the length of the second portion. The second portion may extend in a direction substantially parallel to a longitudinal axis of the midsole and may receive a distal end of the prosthesis when the prosthesis is fully inserted into the article of footwear.

24 Claims, 4 Drawing Sheets

ARTICLE OF FOOTWEAR FOR USE WITH A PROSTHETIC

FIELD

The present disclosure relates to an article of footwear and more particularly to an article of footwear for use with a prosthetic.

BACKGROUND

Recent advancements in prosthetics provide amputees with the ability to participate in virtually any physical activity. For example, prosthetic limbs having a so-called "blade" are commonly used following unilateral and bilateral below-the-knee amputations and following unilateral and bilateral above-the-knee amputations to provide a person with the ability to not only walk but also to perform at a high level in running, hiking, and cross training. In short, prosthetic blades allow amputees to return to an active, physical lifestyle following surgery.

While prosthetics allow a person to maintain an active lifestyle, such prosthetics generally require application of an elastomeric material to a bottom surface of the prosthetic to provide a person with sufficient traction during use. Such materials are typically bonded directly to the prosthetic and are therefore difficult to attach and remove. In fact, removal of most elastomers from prosthetic feet often results in damage to the prosthetic. Further, while application of an elastomer to a prosthetic blade improves performance of the blade, such elastomers do not alter the overall appearance of the blade and certainly do not make the blade appear to look more like a human leg or foot.

This section provides background information related to the present disclosure which is not necessarily prior art.

SUMMARY

This section provides a general summary of the disclosure, and is not a comprehensive disclosure of its full scope or all of its features.

An article of footwear for a prosthesis is provided and may include an upper, an outsole attached to the upper, and a midsole disposed between the upper and the outsole. The article of footwear may also include a cavity having a first portion defined between the upper and the midsole that receives the prosthesis when the prosthesis is inserted into the article of footwear and a second portion having a constant dimension between the upper and the midsole along the length of the second portion. The second portion may extend in a direction substantially parallel to a longitudinal axis of the midsole and may receive a distal end of the prosthesis when the prosthesis is fully inserted into the article of footwear.

In another configuration, an article of footwear for a prosthesis is provided and may include an upper, an outsole attached to the upper, and a midsole disposed between the upper and the outsole. A first fastening device may extend from the midsole and may selectively engage the prosthesis in an engaged state to restrict removal of the prosthesis from the article of footwear.

In yet another configuration, an article of footwear for a prosthesis is provided and may include an upper, an outsole attached to the upper, and a midsole disposed between the upper and the outsole. A cavity may be defined between the upper and the midsole and may include a substantially rectangular cross section that matingly receives the prosthesis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
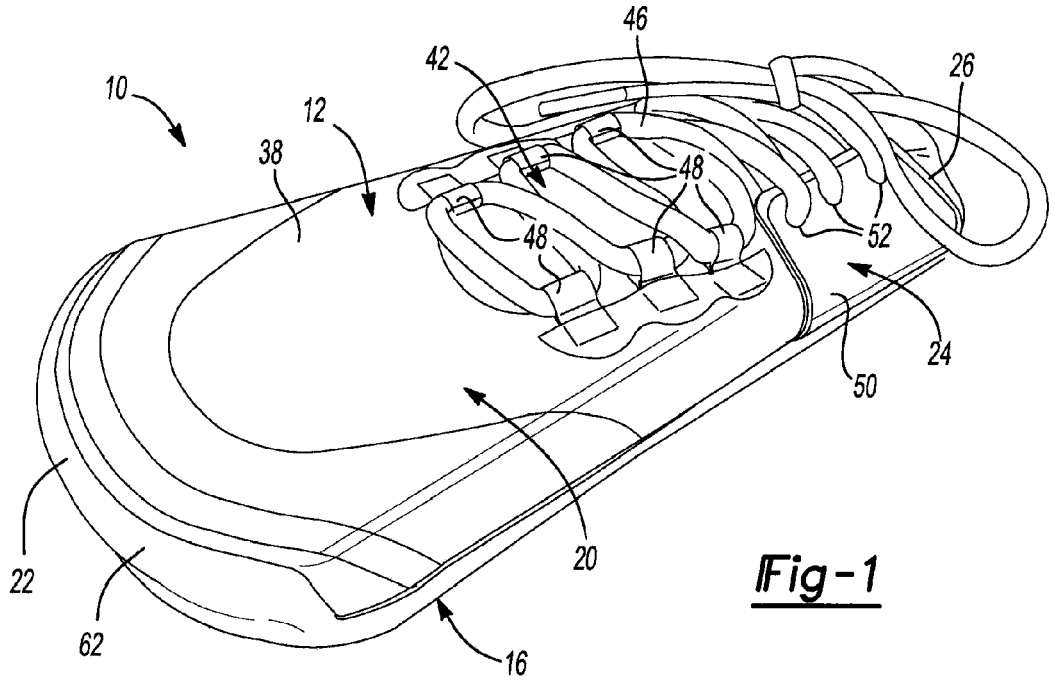
FIG. 1 is a perspective view of an article of footwear in accordance with the principles of the present disclosure.

Example embodiments will now be described more fully with reference to the accompanying drawings.

With reference to the figures, an article of footwear 10 is provided and includes an upper 12, a midsole 14, and an outsole 16. The upper 12 and the midsole 14 cooperate to position and retain a prosthetic 18 (FIG. 7) during use of the article of footwear 10. Maintaining a position of the prosthetic 18 relative to the upper 12 and the midsole 14 likewise maintains a position of the prosthetic 18 relative to the outsole 16, which allows the outsole 16 to provide the prosthetic 18 with a resilient surface that protects and enhances performance of the prosthetic 18 during use.

The upper 12 may include a first portion 20 disposed proximate to a toe box or first end 22 of the article of footwear 10 and a second portion 24 disposed proximate to a second end 26 of the article of footwear 10. The first portion 20 may cooperate with the second portion 24 to define a cavity 28 (FIG. 6) that selectively receives the prosthetic 18 (FIG. 7).

In one configuration, the first portion 20 includes a relatively rigid substrate 30 (FIGS. 6 and 7) that cooperates with the midsole 14 to provide the first portion 20 with a degree of rigidity. For example, the substrate 30 may be formed from a suitable polyurethane (PU) foam that is bonded or otherwise attached to the midsole 14 at a first end 32. While the substrate 30 is described as being formed from a polyurethane foam, the substrate 30 could be formed from virtually any material that provides the first portion 20 with a degree of rigidity.

The substrate 30 may extend in a direction substantially parallel to a longitudinal axis 34 of the article of footwear 10 such that the substrate 30 extends along the entire first portion 20. In fact, the substrate 30 may define the length of the first portion 20 such that a second end 36 (FIG. 6) of the substrate 30 defines a junction between the first portion 20 and the second portion 24.

Figure 6:
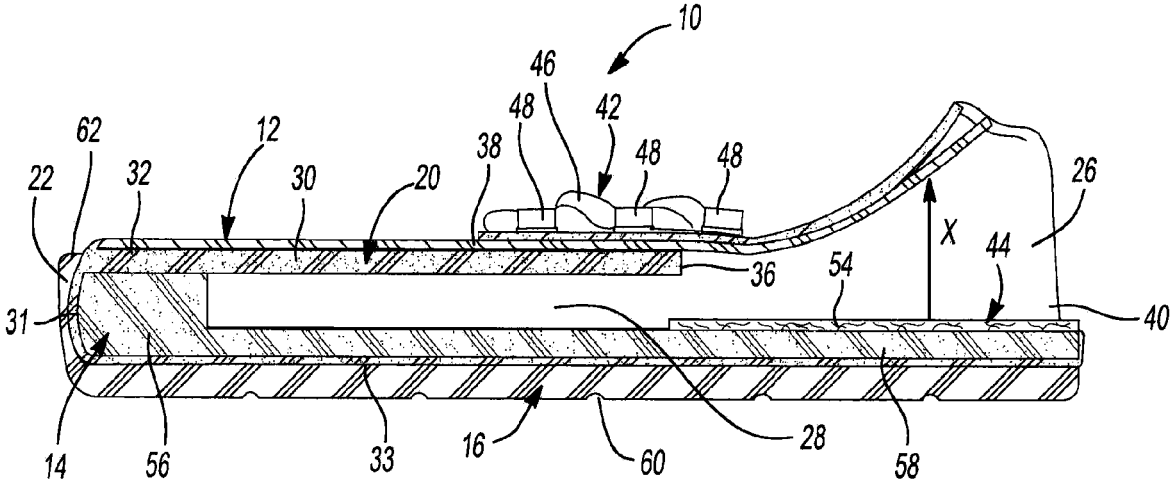
FIG. 6 is a cross-sectional view of the article of footwear of FIG. 1 taken along line 6-6 of FIG. 2.
Figure 7:
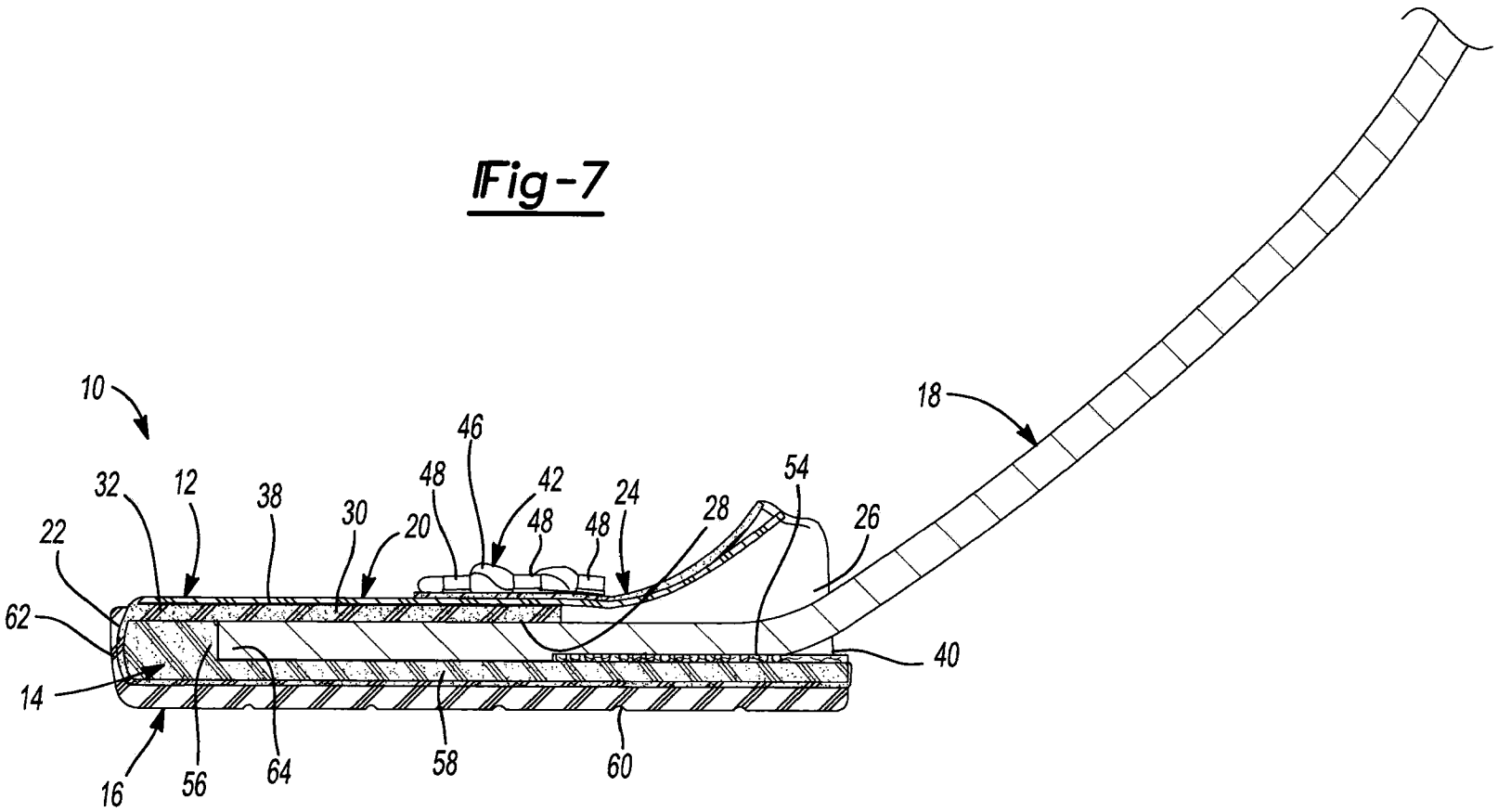
FIG. 7 is a cross-sectional view of the article of footwear of FIG. 1 showing a prosthetic inserted into the article of footwear.

In one configuration, the substrate 30 provides the cavity 28—at the first portion 20—with a substantially rectangular cross-section extending in a direction substantially parallel to the longitudinal axis 34 (FIG. 6). Further, while not illustrated, the substrate 30 also provides the cavity 28—at the first portion 20—with a substantially rectangular cross-section extending in a direction substantially perpendicular to the longitudinal axis 34 at the first portion 20. Providing the cavity 28 with a substantially rectangular cross section at the first portion 20 allows the first portion 20 to matingly receive a so-called "blade" prosthesis 18, as shown in FIG. 7.

The substrate 30 may also include a first portion 31 that extends around an end of the midsole 14 and a second portion 33 that extends between the midsole 14 and the outsole 16. As shown in FIG. 6, the second portion 33 may extend substantially along a length of the article of footwear 10 between the midsole 14 and the outsole 16.

The first portion 20 additionally includes an outer layer 38 that is bonded to and covers the substrate 30. The outer layer 38 may be formed from virtually any material to provide the article of footwear 10 with a desired aesthetic appearance. For example, the outer layer 38 may be formed from a fabric, a rubber, and/or a plastic material that cooperate to provide the first portion 20 and, thus, the article of footwear 10, with a desired appearance.

The second portion 24 may be defined generally between the second end 36 of the substrate 30 and an opening 40 of the article of footwear 10. The second portion 24 may be at least partially defined by the outer layer 38 (FIG. 6) and may include an upper attachment feature 42 and a lower attachment feature 44. The upper attachment feature 42 and the lower attachment feature 44 are be used to secure the article of footwear 10 to the prosthetic 18 when the prosthetic 18 is received within the cavity 28 defined by the first portion 20 and the second portion 24. While the article of footwear 10 will be described and shown hereinafter as including the upper attachment feature 42 and the lower attachment feature 44, the article of footwear 10 could alternatively include only one of the upper attachment feature 42 and the lower attachment feature 44.

In one configuration, the upper attachment feature 42 includes a lace 46 that is supported by the upper 12 proximate to the second portion 24 by a series of retention features 48. The lace 46 may additionally be supported relative to the second portion 24 by a pair of straps 50 that extend from opposite sides of the article of footwear 10. Specifically, one of the straps 50 may extend from a medial side of the article of footwear 10, while the other strap 50 extends from a lateral side of the article of footwear 10. Each strap 50 may include one or more eyelets 52 that slideably receive the lace 46 therein.

The lace 46 of the upper attachment feature 42 may be used to attach the article of footwear 10 to the prosthetic 18 by drawing the retention features 48 closer to one another and by drawing the straps 50 closer to one another. Drawing the retention features 48 toward one another and drawing the straps 50 toward one another causes the second portion 24 of the upper 12 to be constricted about the prosthetic 18. Constricting the second portion 24 of the upper 12 about the prosthetic 18 attaches the article of footwear 10 to the prosthetic 18 by inhibiting removal of the prosthetic 18 at the opening 40.

When the lace 46 is in a relaxed state, the outer layer 38 may be moved in a direction (X; FIG. 6) away from the midsole 14, thereby increasing the effective size of the opening 40. The outer layer 38 may be moved in the direction (X), as the outer layer 38 may be freely movable relative to the midsole 14 at the second portion 24. Conversely, the outer layer 38 may be restricted from moving in the direction (X) at the first portion 20, as the outer layer 38 may be attached to the substrate 30 at the first portion 20. In short, the outer layer 38 may be substantially fixed relative to the midsole 14 by the substrate 30 at the first portion 20 while the outer layer 38 may be permitted to move in the direction (X) at the second portion 24. Accordingly, the second portion 24 is provided with a degree of flexibility when compared to the first portion 20.

Increasing the effective size of the opening 40 by permitting movement of the outer layer 38 in the direction (X) at the second portion 24 facilitates insertion of the prosthetic 18 by allowing the prosthetic 18 to be inserted into the article of footwear 10 at an angle to properly position the prosthetic within the cavity 28. Once the prosthetic 18 is received by the opening 40 and is properly positioned within the cavity 28, the lace 46 may cooperate with the retention features 48 and the straps 50 to constrict the second portion 24 of the upper 12 about the prosthetic 18, thereby inhibiting removal of the prosthetic 18 from the opening 40. While the upper attachment feature 42 is described as including a lace 46, the upper attachment feature 42 could additionally or alternatively include a strap incorporating a hook-and-loop fastener such as Velcro®, a buckle, or a strap incorporating a ratcheting cinch (none shown).

The lower attachment feature 44 may cooperate with the upper attachment feature 42 to inhibit movement of the prosthetic 18 relative to the article of footwear 10 when the prosthetic 18 is inserted into the cavity 28. In one configuration, the lower attachment feature 44 is a hook-and-loop fastener 54 such as Velcro® that is attached to the midsole 14. While the lower attachment feature 44 will be described and shown hereinafter as including a hook-and-loop fastener 54, the lower attachment feature 44 could be virtually any fastener that selectively attaches the prosthetic 18 to the midsole 14. For example, the lower attachment feature 44 could include one or more of a snap, a clip, and an adhesive.

The hook-and-loop fastener 54 includes a first portion that is attached to the midsole 14 and a second portion that is attached to the prosthetic 18. Accordingly, when the prosthetic 18 is inserted into the article of footwear 10, the second portion of the hook-and-loop fastener 54 engages the first portion of the hook-and-loop fastener 54 associated with the midsole 14 to attach the prosthetic 18 to the article of footwear 10 at the midsole 14. Attaching the prosthetic 18 to the article of footwear 10 at the midsole 14 via the hook-and-loop fastener 54 restricts movement of the prosthetic 18 relative to the midsole 14 and, thus, restricts removal of the prosthetic 18 from the article of footwear 10 at the opening 40.

The midsole 14 is disposed generally between the upper 12 and the outsole 16 and may be formed from the same material as the substrate 30. For example, the midsole 14 may be formed from a suitable polyurethane (PU) foam to provide the article of footwear 10 with a degree of cushioning at the midsole 14. While the midsole 14 is described and shown as being formed from the same material as the substrate 30, the midsole 14 could alternatively be formed from a different material.

The midsole 14 may include an end 56 (FIGS. 6 and 7) that extends generally between the upper 12 and the outsole 16 and is attached to the first end 32 of the substrate 30. As described above, the substrate 30 may include a first portion 31 and a second portion 33 that essentially wrap around the midsole 14 such that the substrate 30 extends along a length of the article of footwear 10 and between the midsole 14 and the outsole 16.

In one configuration, the midsole 14 additionally includes a main body 58 that extends generally between the end 56 of the midsole 14 and the opening 40 of the article of footwear 10. The main body 58 may be formed from the same material as the end 56 and may be integrally formed with the end 56.

The outsole 16 may be attached to the upper 12 and to the midsole 14 via the substrate 30 and may be formed from an elastomeric material. Specifically, the outsole 16 may be attached to the midsole 14 by attaching the outsole 16 to the first portion 31 and to the second portion 33 of the substrate 30 along a length of the article of footwear 10. The outsole 16 may include a tread pattern 60 that provides the outsole 16 and, thus, the article of footwear 10, with a degree of flexibility during use of the article of footwear 10. The outsole 16 may also include a lip 62 that extends around a front portion of the article of footwear 10 and generally towards the upper 12. The lip 62 provides the front portion of the article of footwear 10 with increased strength and/or rigidity to protect the front portion of the article of footwear 10 during use.

While the outsole 16 is described and shown as including a tread pattern 60 that facilitates use of the article of footwear 10 during use, the outsole 16 may include a different construction. For example, the outsole 16 may include a series of cleats (not shown) if the article of footwear 10 is intended for use during an athletic activity such as baseball, football, or golf. The cleats may be integrally formed with the outsole 16 or, alternatively, may be removably attached to the outsole 16. Conversely, the outsole 16 may include a specific tread pattern that facilitates hiking or running, depending on the particular application and use of the article of footwear 10.

Figure 3:
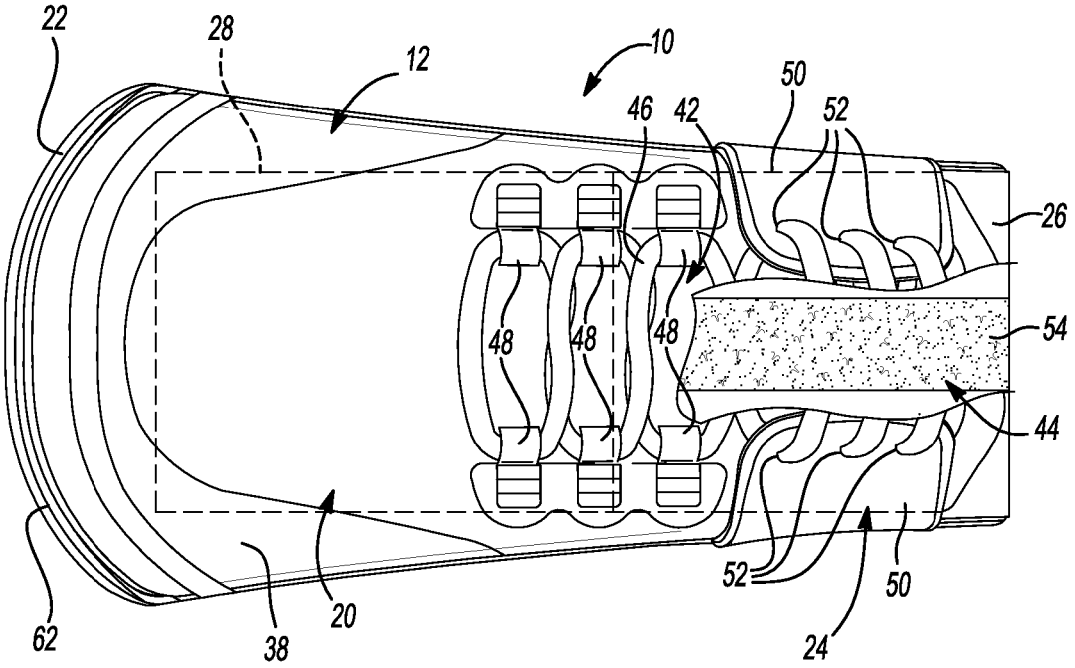
FIG. 3 is a top view of the article of footwear of FIG. 1 with part of an upper removed to show a fastening device.
Figure 4:
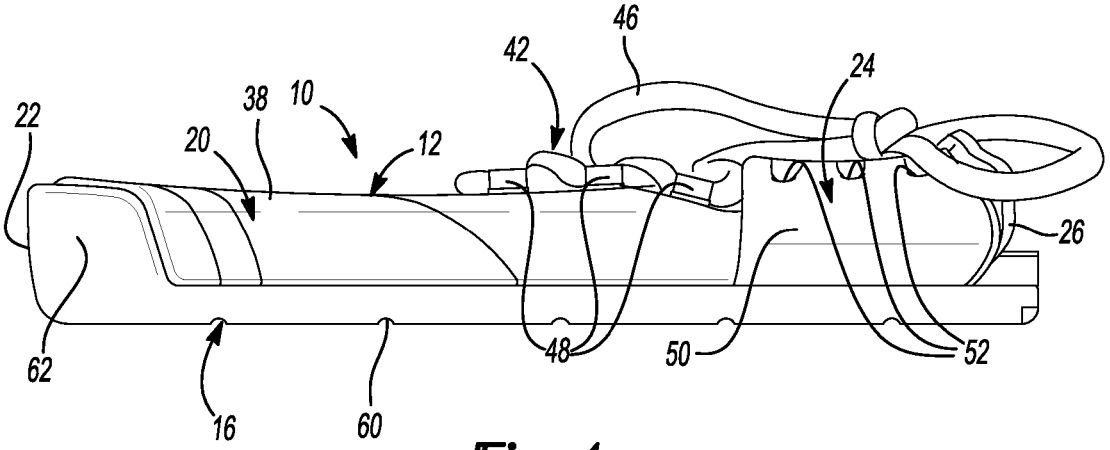
FIG. 4 is a side view of the article of footwear of FIG. 1.
Figure 5:
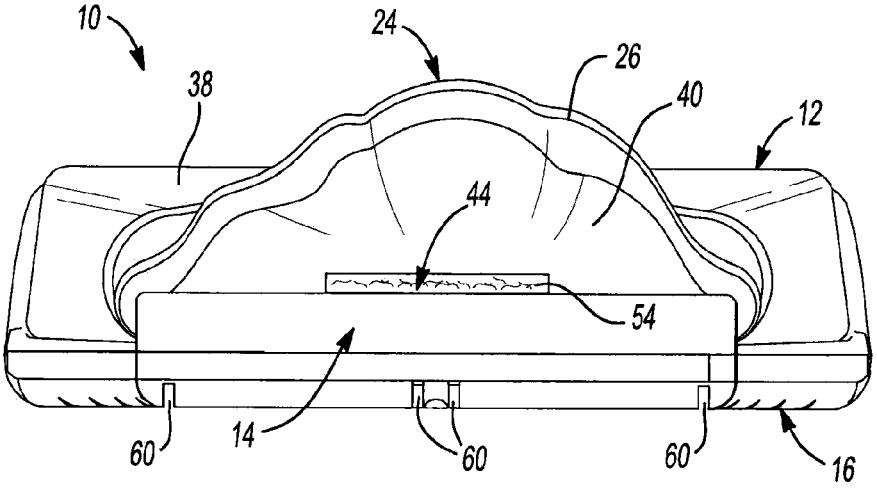
FIG. 5 is a rear view of the article of footwear of FIG. 1.

With particular reference to FIGS. 3, 6, and 7, operation of the article of footwear 10 will be described in detail. Prior to insertion of the prosthetic 18 into the article of footwear 10, the attachment feature 42 is moved into a relaxed state to allow the second portion 24 of the upper 12 to be moved in the direction (X). In so doing, the straps 50 are permitted to move generally away from one another such that one of the straps 50 moves toward the medial side of the article of footwear 10 and the other strap 50 moves toward the lateral side of the article of footwear 10.

Moving the straps 50 in opposite directions and away from one another allows the second portion 24 to move in the direction (X), which increases the effective size of the opening 40. Increasing the effective size of the opening 40 allows the prosthetic 18 to be easily inserted into the cavity 28, as described above.

Once the prosthetic 18 is sufficiently received within the cavity 28, a distal end 64 of the prosthetic 18 is disposed substantially between the substrate 30 and the midsole 14. As such, the prosthetic 18 may be simultaneously in contact with the substrate 30 and with the midsole 14 substantially along the entire length of the first portion 20 to retain and position the prosthetic 18 relative to and within the cavity 28.

In one configuration, the cavity 28 includes a substantially constant width along a length of the first portion 20. Accordingly, the substrate 30 may be spaced apart and separated from the midsole 14 by the same distance along the entire length of the substrate 30 to accommodate the constant width of the prosthetic 18 when the prosthetic 18 is received within the cavity 28. Further, the size of the cavity 28 may be such that the substrate 30 and the midsole 14 are in contact with opposite sides of the prosthetic 18 when the prosthetic 18 is received within the cavity 28 to retain and position the prosthetic within the cavity 28.

Once the distal end 64 of the prosthetic 18 is fully inserted into the cavity 28 such that the distal end 64 is disposed proximate to or abutting the end 56 of the midsole 14, a force may be applied to the prosthetic 18 in a direction substantially opposite to direction (X) to allow the second portion of the hook-and-loop fastener 54 associated with the prosthetic 18 to engage the first portion of the hook-and-loop fastener 54 associated with the midsole 14. Once the second portion of the hook-and-loop fastener 54 is engaged with the first portion of the hook-and-loop fastener 54, the prosthetic 18 is attached to the midsole 14 and is restricted from being removed from the article of footwear 10 at the opening 40.

Figure 2:
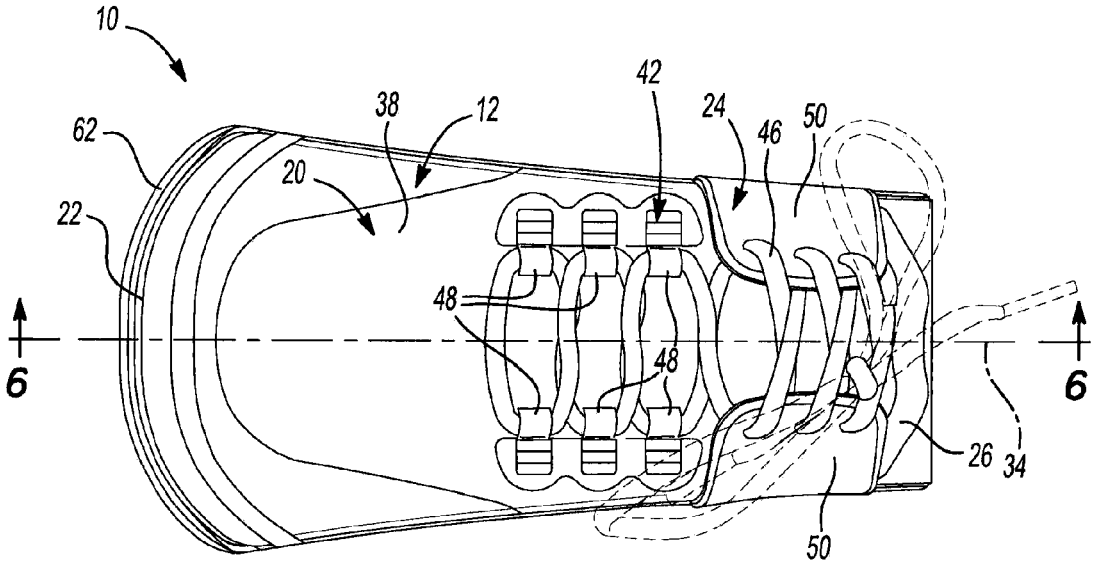
FIG. 2 is a top view of the article of footwear of FIG. 1.

The lace 46 may be moved from the relaxed state to a constricted state to cause the second portion 24 of the upper 12 to be constricted about the prosthetic 18 proximate to the opening 40. Namely, a force may be applied to the lace 46 to cause the retention features 48 and the straps 50 to move in a direction toward the longitudinal axis 34 (FIG. 2). Movement of the retention features 48 and the straps 50 toward the axis 34 causes the second portion 24 of the upper 12 to be constricted about the prosthetic 18, thereby fixing a position of the prosthetic 18 relative to the upper 12 and the midsole 14. Fixing a position of the prosthetic 18 relative to the upper 12 and the midsole 14 restricts movement of the prosthetic 18 from the article of footwear 10 at the opening 40.

Once the upper 12 is sufficiently constricted about the prosthetic 18, the lace 46 may be tied to retain a position of the retention features 48 and the straps 50 relative to the prosthetic 18. Retaining a position of the retention features 48 and the straps 50 relative to the prosthetic 18 likewise maintains the upper 12 in the constricted state during use of the article of footwear 10.

Once the hook-and-loop fastener 54 is engaged with the prosthetic 18 and the lace 46 sufficiently constricts the upper 12 about the prosthetic 18, the prosthetic 18 is fixed for movement with the article of footwear 10. At this point, a force may be applied to the prosthetic during use which, in turn, is applied to the article of footwear 10 without causing relative movement between the article of footwear 10 and the prosthetic 18. Accordingly, the article of footwear 10 acts as an extension of the prosthetic 18, thereby providing the prosthetic 18 with increased friction between the prosthetic 18 and the ground due to the elastomeric material of the outsole 16.

The article of footwear 10 may be removed from the prosthetic 18 by returning the lace 46 to the relaxed state by untying the lace 46. Untying the lace 46 allows the retention features 48 and the straps 50 to move in a direction away from the axis 34, which allows movement of the outer layer 38 in the direction (X). Movement of the outer layer 38 in the direction (X) likewise allows the prosthetic 18 to move in the direction (X). Upon sufficient movement of the prosthetic 18 in the direction (X), the second portion of the hook-and-loop fastener 54 associated with the prosthetic 18 disengages the first portion of the hook-and-loop fastener 54 associated with the midsole 14, thereby allowing the prosthetic 18 to be removed from the article of footwear 10 at the opening 40.

As described above, the article of footwear 10 provides the prosthetic 18 with increased function during use by increasing friction between the prosthetic 18 and the ground during use and, further, by protecting the prosthetic 18. The article of footwear 10 additionally improves the overall appearance of the prosthetic 18 by mimicking the look and shape of a conventional article of footwear. Namely, the article of footwear 10 may be provided with a shape such that the article of footwear 10 widens in a direction extending from the opening 40 to the lip 62.

As shown in FIG. 2, the article of footwear 10 includes a substantially constant taper extending between the opening 40 and the lip 62. The taper provides the article of footwear 10 with the appearance of a conventional article of footwear and, further, increases an area of contact between the outsole 16 and the ground, thereby improving balance during use. Accordingly, if a user wears a conventional shoe on a first leg and wears the article of footwear 10 on a prosthetic 18 of a second leg, the article of footwear 10 approximates the shape of the conventional shoe, thereby allowing the article of footwear 10 to look like the conventional shoe. Accordingly, the article of footwear 10 not only protects and increases the overall performance of the prosthetic 18, but also provides the prosthetic 18 with a desired aesthetic appearance.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An article of footwear for a prosthesis, the article of footwear comprising:

an upper;

an outsole attached to said upper;

a midsole disposed between said upper and said outsole; and a cavity defined between said upper and said midsole and configured to receive the prosthesis into an opening when the prosthesis is inserted into the article of footwear, wherein the cavity extends in a direction substantially parallel to the longitudinal axis of the midsole and has a constant dimension between said upper and said midsole along the length of the cavity; wherein an outer width of the article of footwear increases from the opening of the cavity to a distal end of the article of footwear.

2. The article of footwear of claim 1, wherein said upper is selectively movable between an expanded state and a constricted state proximate to the opening of the cavity, said upper movable into said expanded state to facilitate insertion of the prosthesis into the article of footwear and movable into said constricted state to restrict removal of the prosthesis from the article of footwear.

3. The article of footwear of claim 2, further comprising a fastening device operable to restrict removal of the prosthesis from the article of footwear.

4. The article of footwear of claim 3, wherein said fastening device is a lace operable to maintain said upper in said constricted state.

5. The article of footwear of claim 1, further comprising a fastening device operable to engage the prosthesis to restrict relative movement between the prosthesis and the article of footwear.

6. The article of footwear of claim 5, wherein said fastening device is a hook-and-loop fastener.

7. The article of footwear of claim 1, wherein the cavity having a substantially rectangular cross-section.

8. The article of footwear of claim 1, wherein said upper and said midsole are simultaneously in contact with opposite sides of the prosthesis when the prosthesis is received within said cavity.

9. An article of footwear for a prosthesis, the article of footwear comprising:

an upper;

an outsole attached to said upper;

a midsole disposed between said upper and said outsole; and a first fastening device extending from said midsole and configured at a proximate end of the midsole to selectively engage the prosthesis in an engaged state to restrict removal of the prosthesis from the article of footwear, wherein an outer width of the article of footwear increases from the proximate end of the midsole along a longitudinal axis of the midsole to a distal end of the midsole; and a cavity defined between said upper and said midsole, said cavity including a constant width and a substantially rectangular cross section configured to matingly receive the prosthesis.

10. The article of footwear of claim 9, wherein said first fastening device is moved from a disengaged state to said engaged state by moving the prosthesis in a direction substantially perpendicular to said midsole and toward said first fastening device.

11. The article of footwear of claim 10, further comprising a second fastening device attached to the prosthesis, said second fastening device attached to said first fastening device in said engaged state to attach the prosthesis to said midsole.

12. The article of footwear of claim 10, wherein said first fastening device is a hook-and-loop fastener.

13. The article of footwear of claim 9, wherein said first fastening device is a hook-and-loop fastener.

14. The article of footwear of claim 9, further comprising a second fastening device operable to restrict removal of the prosthesis from the article of footwear.

15. The article of footwear of claim 14, wherein said second fastening device includes a lace operable to selectively constrict said upper around the prosthesis when the prosthesis is inserted into the article of footwear.

16. The article of footwear of claim 14, wherein said upper includes a first portion supporting said second fastening device and a second portion disposed proximate to a toe box of the article of footwear, said first portion being more flexible than said second portion to permit said upper to selectively move away from said midsole during installation of the prosthesis into the article of footwear.

17. The article of footwear of claim 9, wherein said cavity is disposed proximate to a toe box of the article of footwear.

18. An article of footwear for a prosthesis, the article of footwear comprising:

an upper;

an outsole attached to said upper;

a midsole disposed between said upper and said outsole; and a cavity defined between said upper and said midsole and including a substantially rectangular cross section, said cavity configured to matingly receive the prosthesis into an opening defined at a proximate end of the midsole, wherein an outer width of the outsole increases from the proximate end of the midsole along a longitudinal axis of the midsole to a distal end of the midsole; and wherein said cavity includes a substantially constant dimension between said Upper and said midsole along the length of said cavity, said cavity extending in a direction substantially parallel to a longitudinal axis of said midsole.

19. The article of footwear of claim 18, further comprising a first fastening device operable to selectively engage the prosthesis in an engaged state to restrict removal of the prosthesis from the article of footwear.

20. The article of footwear of claim 19, wherein said first fastening device is moved from a disengaged state to said engaged state by moving the prosthesis in a direction substantially perpendicular to said midsole and toward said first fastening device.

21. The article of footwear of claim 19, wherein said first fastening device is a hook-and-loop fastener.

22. The article of footwear of claim 19, wherein said first fastening device is a lace associated with said upper, said lace operable to constrict said upper around the prosthesis in said engaged state.

23. The article of footwear of claim 18, wherein said cavity is disposed proximate to a toe box of the article of footwear.

24. The article of footwear of claim 18, wherein said upper and said midsole are simultaneously in contact with opposite sides of the prosthesis when the prosthesis is received within said cavity.

* * * * *